US008842046B2

(12) United States Patent
Seok et al.

(10) Patent No.: US 8,842,046 B2
(45) Date of Patent: Sep. 23, 2014

(54) LOOP ANTENNA

(75) Inventors: Eunyoung Seok, Plano, TX (US); Brian P. Ginsburg, Allen, TX (US); Baher Haroun, Allen, TX (US); Srinath Ramaswamy, Murphy, TX (US); Vijay B. Rentala, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 699 days.

(21) Appl. No.: 13/189,135

(22) Filed: Jul. 22, 2011

(65) Prior Publication Data

US 2013/0021208 A1 Jan. 24, 2013

(51) Int. Cl.

| | |
|---|---|
| ***H01Q 7/00*** | (2006.01) |
| ***H01Q 23/00*** | (2006.01) |
| ***H01Q 1/38*** | (2006.01) |

(52) U.S. Cl.

CPC . *H01Q 7/00* (2013.01); *H01Q 23/00* (2013.01)
USPC ..... 343/700 MS; 343/789

(58) Field of Classification Search

CPC ..... H01Q 1/38; H01Q 9/0435
See application file for complete search history.

(56) References Cited

U.S. PATENT DOCUMENTS

| | | | | |
|---|---|---|---|---|
| 6,154,176 | A | 11/2000 | Fathy et al. | |
| 7,545,329 | B2 | 6/2009 | Gaucher et al. | |
| 7,855,689 | B2 | 12/2010 | Fukui et al. | |
| 2007/0139294 | A1 * | 6/2007 | Dunn et al. | 343/909 |
| 2008/0316109 | A1 | 12/2008 | Savolainen | |
| 2011/0309899 | A1 * | 12/2011 | Leiba et al. | 333/208 |

FOREIGN PATENT DOCUMENTS

WO 2010-087783 A1 8/2010

OTHER PUBLICATIONS

"Wideband Cavity-backed Folded Dipole Superstrate Antenna for 60 GHz Applications," Proceedings of the 2006 IEEE AP-S International Symposium and UNSC/URSI and AMEREM Meetings, Jul. 9-14, 2006pp. 3939-3942, Albuquerque, New Mexico (Grzyb, et al.).
U.S. Appl. No. 12/878,484, filed Sep. 9, 2010.
U.S. Appl. No. 13/116,885, filed May 26, 2011.

* cited by examiner

*Primary Examiner* — Dameon E Levi
*Assistant Examiner* — Ricardo Magallanes
(74) *Attorney, Agent, or Firm* — John R. Pessetto; Frederick J. Telecky, Jr.

(57) ABSTRACT

A loop antenna is provided. The apparatus comprises a substrate, a first metallization layer, and a second metallization layer. The substrate has first and second feed terminals and a ground terminal. The first metallization layer is disposed over the substrate and includes a first window conductive region, a first conductive region, a second conductive region, and a third conductive region. The first conductive region is disposed over and is in electrical contact with the first feed terminal; it is also is substantially circular and located within the first window region. The second conductive region is disposed over and is in electrical contact with the second feed terminal; it is also substantially circular and is located within the first window region. The a third conductive region is disposed over and is in electrical contact with the ground terminal, and the third conductive region substantially surrounds the first window region. The second metallization layer is disposed over and is in electrical contact with the first, second, and third conductive regions of the first metallization layer, and the second metallization layer includes a second window region that is at least partially aligned with the first window region.

14 Claims, 7 Drawing Sheets

FIG. 9
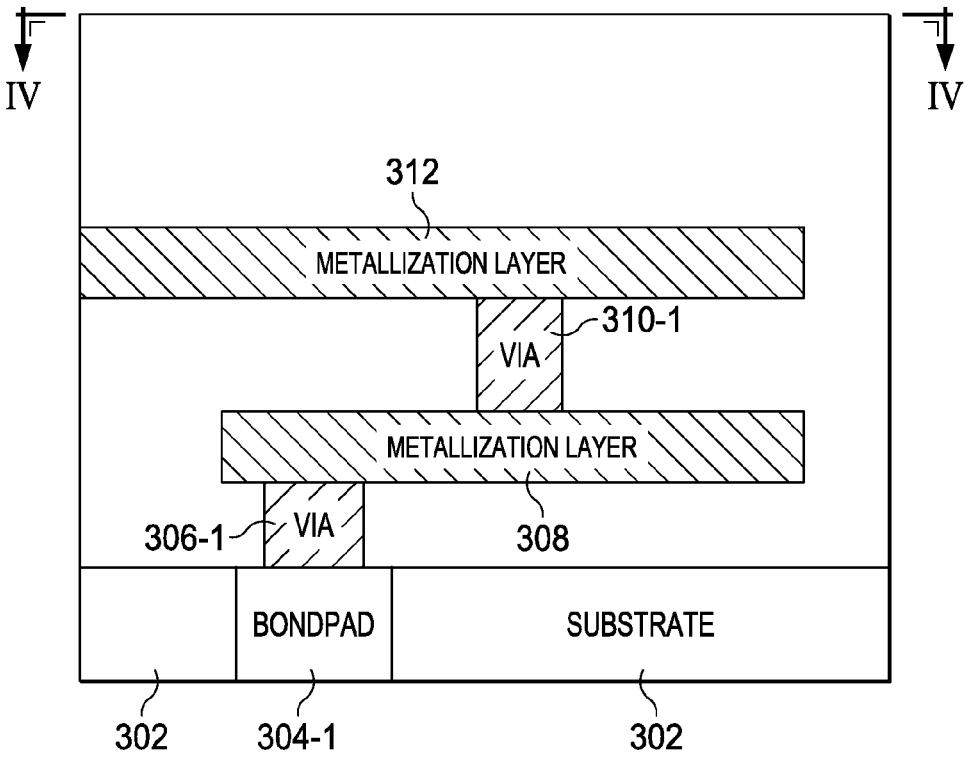
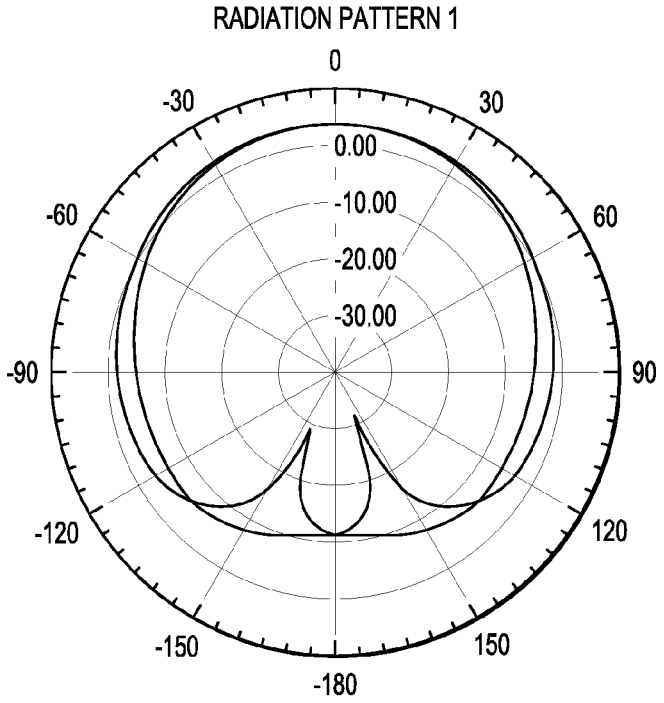
FIG. 10

LOOP ANTENNA

TECHNICAL FIELD

The invention relates generally to a loop antenna and, more particularly, to a loop antenna for use in the terahertz frequency range.

BACKGROUND

Loop antennas have been used in a wide variety of applications over the years, but, for high frequency applications (i.e., terahertz radiation) and for monolithically integrated antennas, there can be a variety of barriers to the use of loops antennas. For example, there can be loses associated with packaging material between the antenna and transmission media. Another example is losses due to parasitic radiation and interface from trances in printed circuit boards or PCBs. Therefore, there is a need for an improved system. Some examples of conventional systems are: U.S. Pat. No. 7,545,329; and J. Grzyb, D. Liu, U. Pfeiffer, and B. Gaucher, "Wideband cavity-backed folded dipole superstrate antenna for 60 GHz applications," *Proceedings of the* 2006 *IEEE AP-S International Symposium and UNSC/URSI and AMEREM Meetings*, pp. 3939-3942, Albuquerque, N. Mex. , Jul. 9-14, 2006.

SUMMARY

An embodiment of the present invention, accordingly, provides an apparatus. The apparatus comprises a substrate having a first feed terminal, a second feed terminal, and a ground terminal; a first metallization layer disposed over the substrate, wherein the first metallization layer includes: a first window region; a first conductive region disposed over and in electrical contact with the first feed terminal, wherein first conductive region is substantially circular, and wherein the first conductive region is located within the first window region; a second conductive region disposed over and in electrical contact with the second feed terminal, wherein the second conductive region is substantially circular, and wherein the first conductive region is located within the first window region; and a third conductive region disposed over and in electrical contact with the ground terminal, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region.

In accordance with an embodiment of the present invention, the ground terminal further comprises a first ground terminal, and wherein the substrate has a second ground terminal, and wherein the first feed terminal, the second feed terminal, the first ground terminal, and the second ground terminal are substantially aligned.

In accordance with an embodiment of the present invention, the first window region is substantially rectangular.

In accordance with an embodiment of the present invention, the apparatus further comprises: a first via that extends between the first ground terminal and the third conductive region; a second via that extends between the second ground terminal and the third conductive region; a third via that extends between the first feed terminal and the first conductive region; and a fourth via that extends between the second feed terminal and the second conductive region.

In accordance with an embodiment of the present invention, the second metallization layer further comprises: a fourth conductive region that substantially surrounds the second widow conductive region and that is in electrical contact with the third conductive region; a fifth conductive region that bisects the second window region and that is electrical contact with the fourth conductive region; a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

In accordance with an embodiment of the present invention, the apparatus further comprises: a set of fifth vias that extends between the third and fourth conductive regions; a sixth via that extends between the first and sixth conductive regions; and a seventh via that extends between the second and seventh conductive regions.

In accordance with an embodiment of the present invention, the first feed terminal, the second feed terminal, the first ground terminal, and the second ground terminal are bondpads.

In accordance with an embodiment of the present invention, an apparatus is provided. The apparatus comprises an integrated circuit (IC) having: radio frequency (RF) circuitry; a first bondpad that is coupled to the RF circuitry; a second bondpad that is coupled to the RF circuitry; and a third bondpad that is coupled to the RF circuitry and that is coupled to ground; an antenna package having: a substrate; a fourth bondpad that is located in the substrate and that is in electrical contact with the first bondpad; a fifth bondpad that is located in the substrate and that is in electrical contact with the second bondpad; a sixth bondpad that is located in the substrate and that is in electrical contact with the third bondpad; a first metallization layer disposed over the substrate, wherein the first metallization layer includes: a first window region; a first conductive region disposed over and in electrical contact with the fourth bondpad, wherein first conductive region is substantially circular, and wherein the first conductive region is located within the first window region; a second conductive region disposed over and in electrical contact with the fifth bondpad, wherein the second conductive region is substantially circular, and wherein the first conductive region is located within the first window region; and a third conductive region disposed over and in electrical contact with the sixth bondpad, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region.

In accordance with an embodiment of the present invention, antenna package further comprises a seventh bondpad, and wherein the fourth, fifth, sixth, and seventh bond pads are substantially aligned, and wherein the IC further comprises an eighth bondpad that is coupled to the RF circuitry and that is coupled to ground, and wherein the seventh bondpad is in electrical contact with the eighth bondpad.

In accordance with an embodiment of the present invention, the apparatus further comprises: a first via that extends between the sixth bondpad and the third conductive region; a second via that extends between the seventh bondpad and the third conductive region; a third via that extends between the fourth bondpad and the first conductive region; and a fourth via that extends between the fifth bondpad and the second conductive region.

In accordance with an embodiment of the present invention, the second metallization layer further comprises: a fourth conductive region that substantially surrounds the second widow conductive region and that is in electrical contact with the third conductive region; a fifth conductive region that bisects the second window region and that is electrical contact with the fourth conductive region; a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

In accordance with an embodiment of the present invention, the apparatus further comprises: a set of fifth vias that extends between the third and fourth conductive regions; a sixth via that extends between the first and sixth conductive regions; and a seventh via that extends between the second and seventh conductive regions.

In accordance with an embodiment of the present invention, an apparatus is provided. The apparatus comprises an integrated circuit (IC) having: a plurality of RF transceivers; a plurality of sets of bondpads, wherein each set of bondpads is associated with at least one of the RF transceivers, and wherein each set of bondpads includes: a first bondpad that is coupled to its associated RF transceiver; a second bondpad that is coupled to its associated RF transceiver; a third bondpad that is coupled to its associated RF transceiver and that is coupled to ground; and a fourth bondpad that is coupled to its associated RF transceiver and that is coupled to ground; an antenna package having: a substrate; an array of antenna, wherein each antenna is associated with at least of the RF transceivers, and wherein each antenna includes: a fifth bondpad that is located in the substrate and that is in electrical contact with its associated first bondpad; a sixth bondpad that is located in the substrate and that is in electrical contact with its associated second bondpad; a seventh bondpad that is located in the substrate and that is in electrical contact with its associated third bondpad; an eighth bondpad that is located in the substrate and that is in electrical contact with its associated third bondpad, wherein the fifth, sixth, seventh, and eight bondpads are substantially aligned; a first metallization layer disposed over the substrate, wherein the first metallization layer includes: a first window region; a first conductive region disposed over and in electrical contact with the fifth bondpad, wherein first conductive region is substantially circular, and wherein the first conductive region is located within the first window region; a second conductive region disposed over and in electrical contact with the sixth bondpad, wherein the second conductive region is substantially circular, and wherein the first conductive region is located within the first window region; and a third conductive region disposed over and in electrical contact with the seventh and eighth bondpads, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region; and a high impedance surface (HIS) disposed on the substrate and substantially surrounding the array of antennas.

In accordance with an embodiment of the present invention, the apparatus further comprises: a first via that extends between the seventh bondpad and the third conductive region; a second via that extends between the eighth bondpad and the third conductive region; a third via that extends between the fifth bondpad and the first conductive region; and a fourth via that extends between the sixth bondpad and the second conductive region.

In accordance with an embodiment of the present invention, the second metallization layer further comprises: a fourth conductive region that substantially surrounds the second widow conductive region and that is in electrical contact with the third conductive region; a fifth conductive region that bisects the second window region and that is electrical contact with the fourth conductive region; a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

In accordance with an embodiment of the present invention, the apparatus further comprises: a set of fifth vias that extends between the third and fourth conductive regions; a sixth via that extends between the first and sixth conductive regions; and a seventh via that extends between the second and seventh conductive regions.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 9 is a cross-sectional view of FIG. 8 along section line IV-IV; and FIG. 10 is a diagram depicting an example of the radiation pattern for the antenna of FIG. 2.

DETAILED DESCRIPTION

Figure 1:
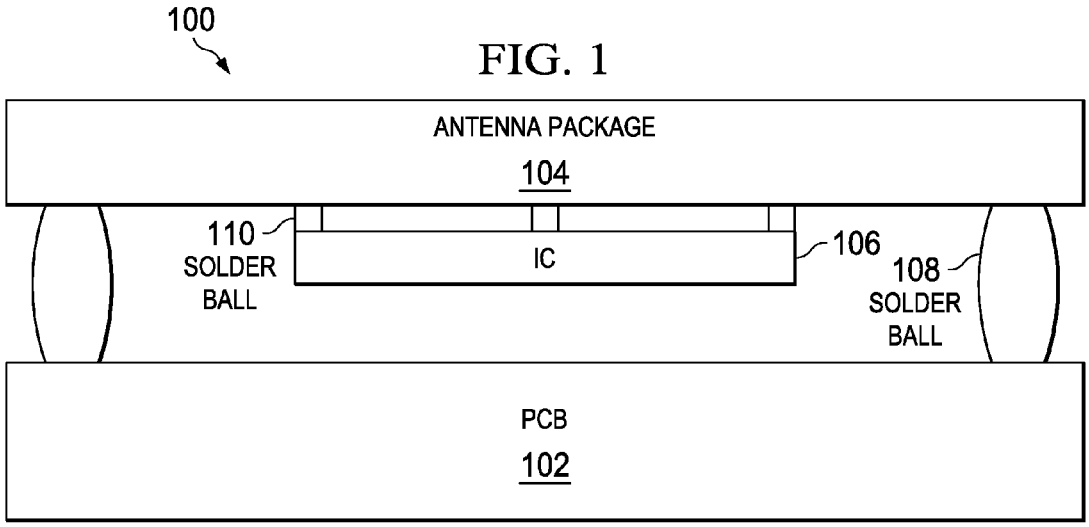
FIG. 1 is a system in accordance with a preferred embodiment of the present invention.
Figure 4:
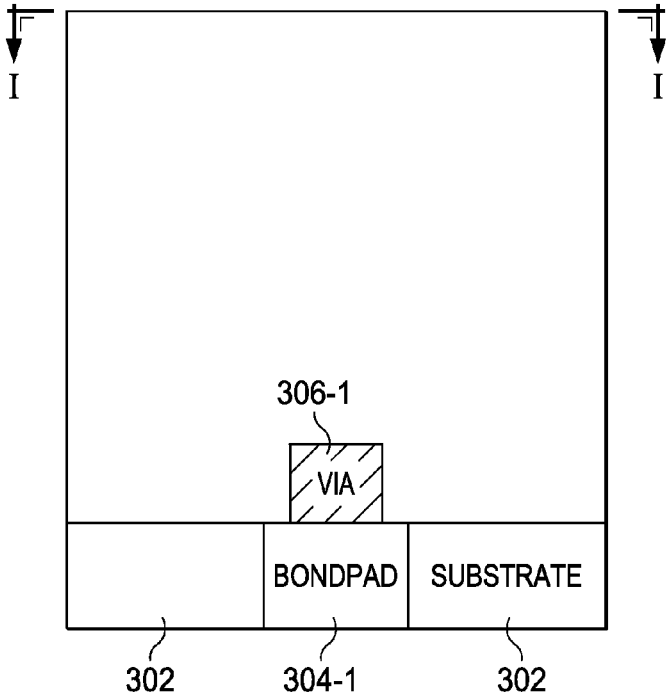
FIG. 4 is a cross-sectional view of FIG. 2 along section line I-I.

Refer now to the drawings wherein depicted elements are, for the sake of clarity, not necessarily shown to scale and wherein like or similar elements are designated by the same reference numeral through the several views.

Turning to FIG. 1, an example of a system 100 in accordance with an embodiment of the present invention can be seen. This system 100 generally comprises a printed circuit board (PCB) 102, an antenna package 104, and an integrated circuit (IC) 106. The IC 106 generally includes radio frequency (RF) circuitry. For example, IC 106 can be a terahertz phased array system that includes multiple transceivers. An example of such an IC can be seen in co-pending U.S. patent application Ser. No. 12/878,484, which is entitled "Terahertz Phased Array System," filed on Sep. 9, 2010, and is hereby incorporated by reference for all purposes. This IC 106 is then secured to the antenna packages 104 to allow each transceiver (for example) to communicate with an antenna included on the antenna package 104. Typically, bondpads on the IC 106 are secured to bondpads on the antenna package 104 through solder balls 110. The antenna package 104 can then be secured to the PCB 102 (which is typically accomplished through bondpads being secured to one another through solder balls 108). By using this arrangement, cross-talk and loss can be reduced.

Figure 2:
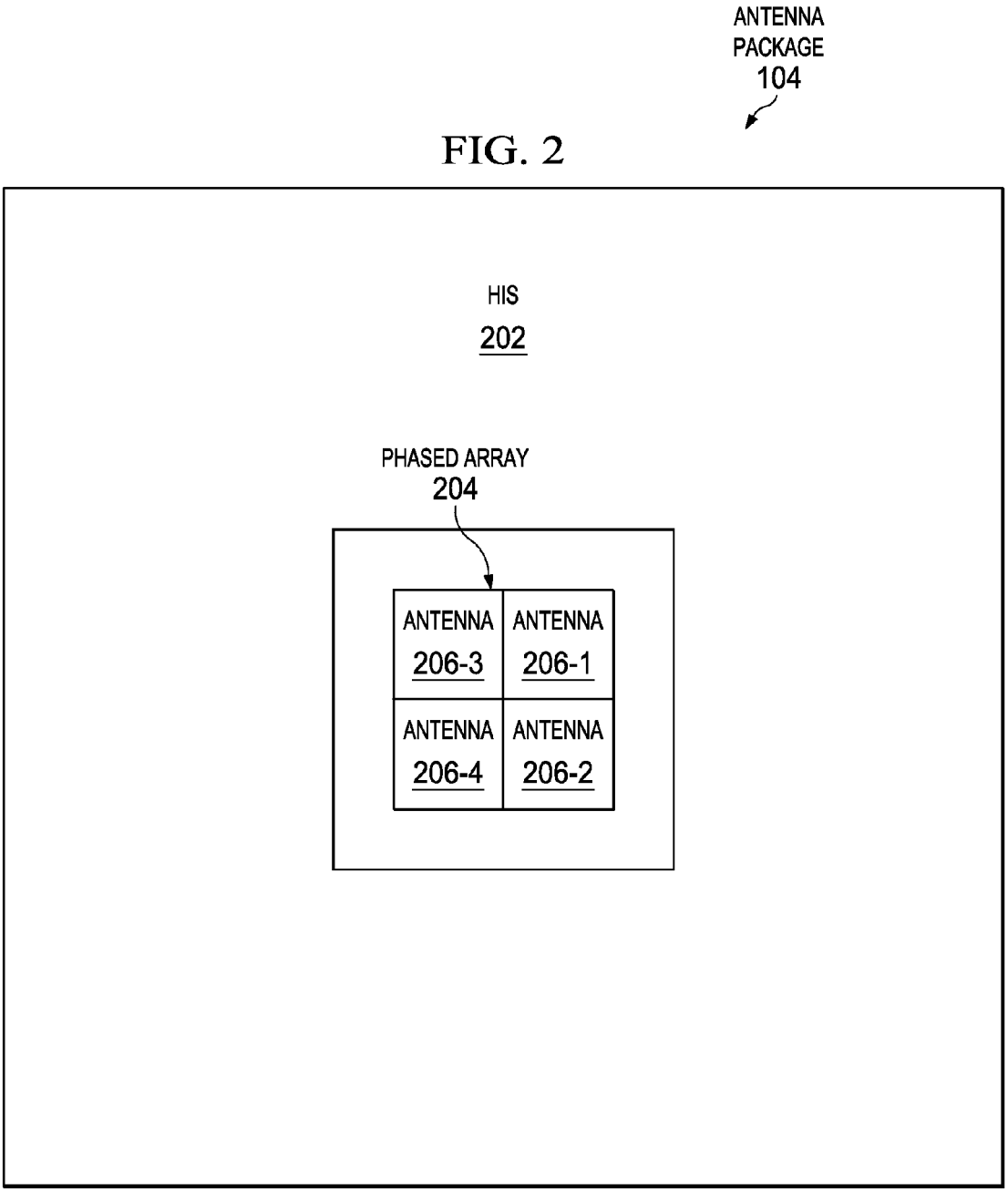
FIG. 2 is a plan view of the antenna package of FIG. 1.
Figure 3:
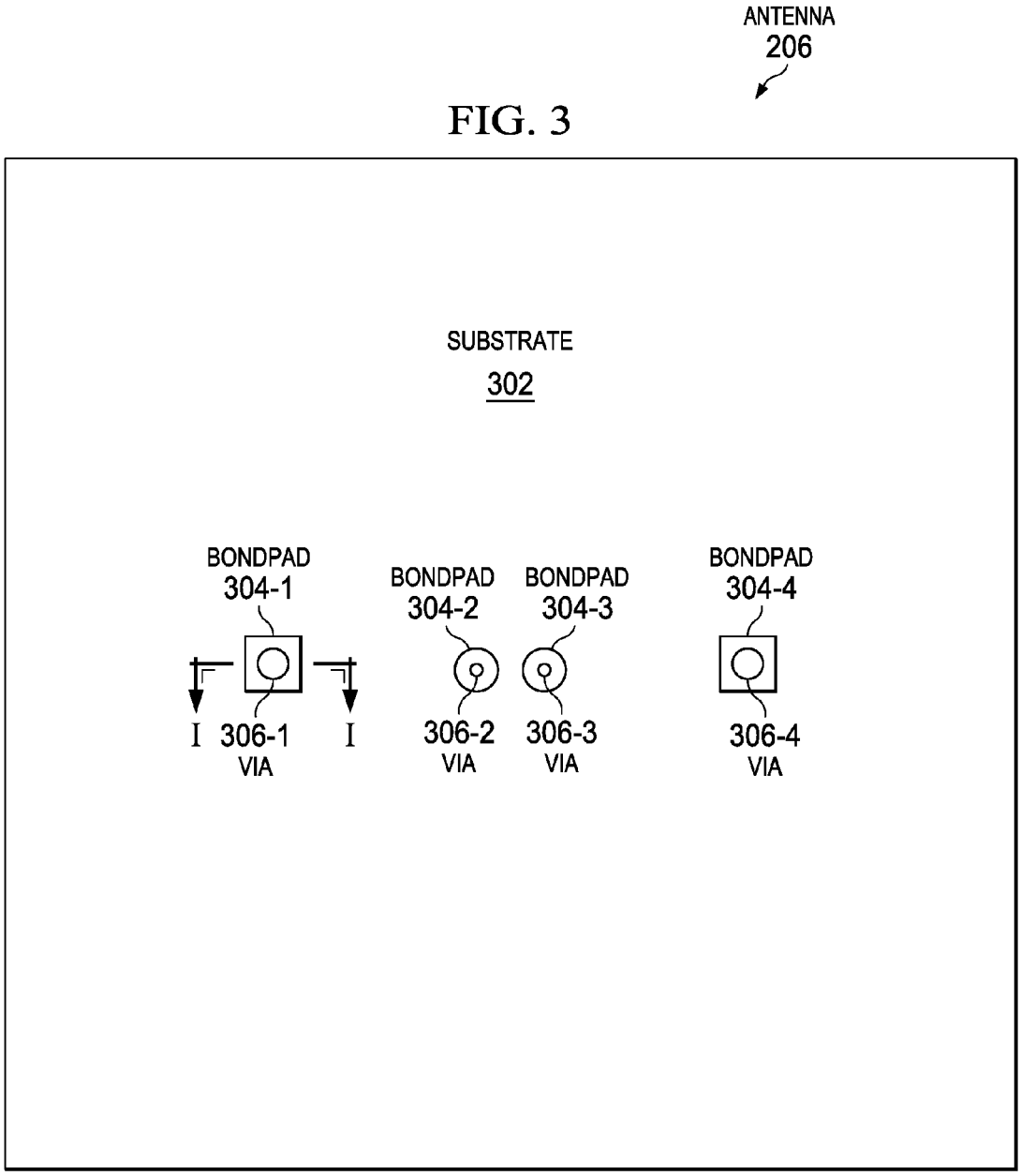
FIG. 3 is a plan view of the substrate for an antenna of FIG. 2.
Figure 5:
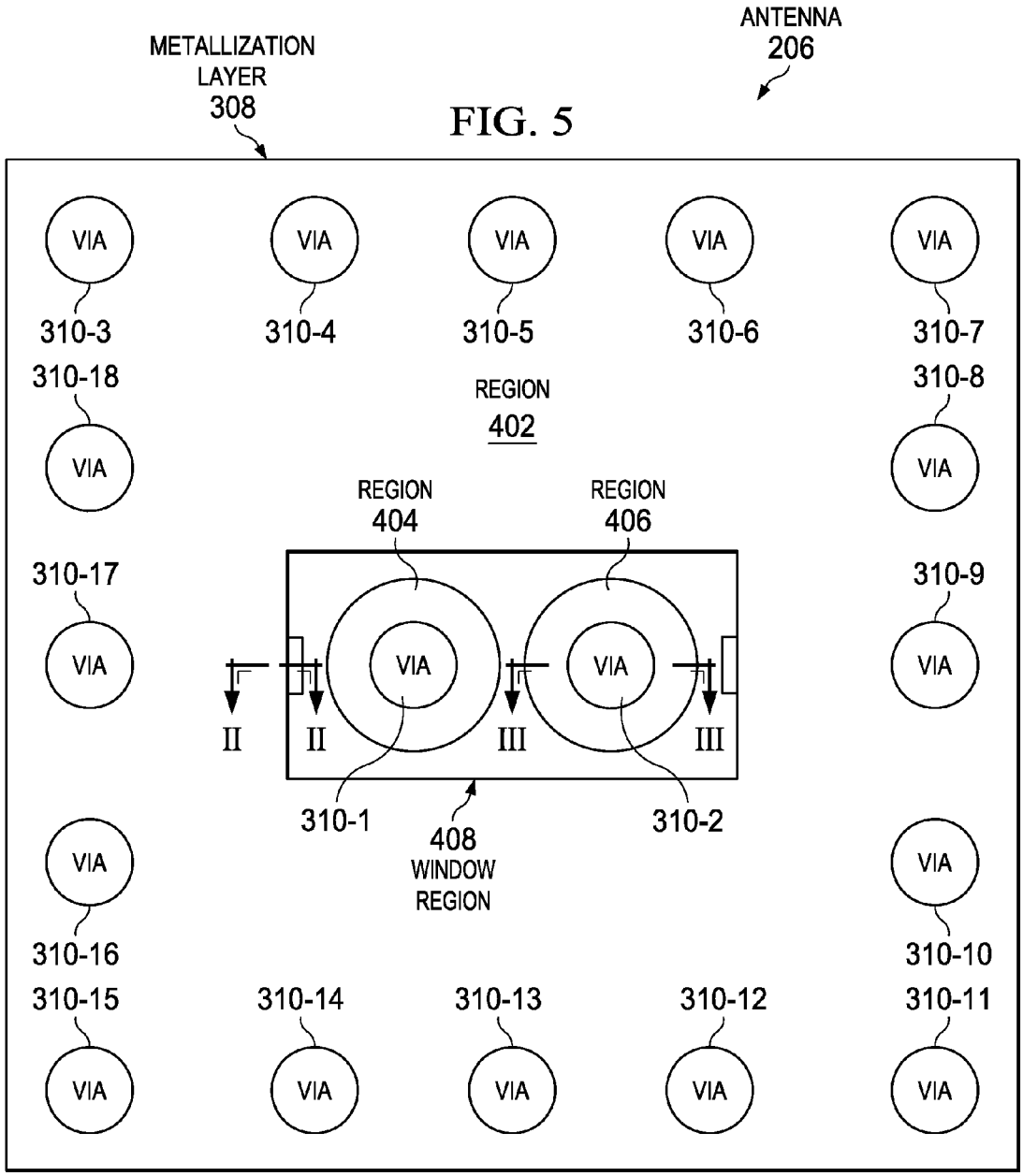
FIG. 5 is a plan view of a metallization layer for the antenna of FIG. 2.
Figure 6:
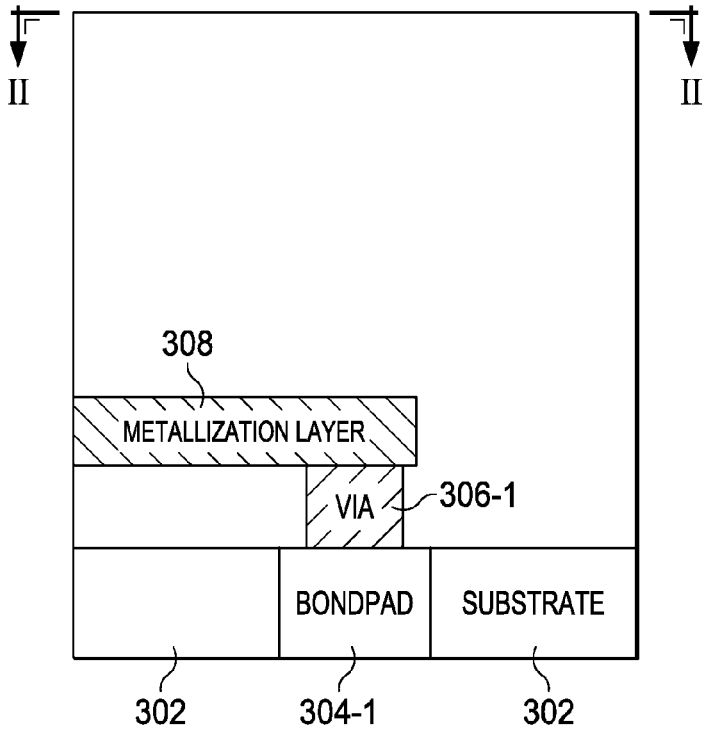
FIG. 6 is a cross-sectional view of FIG. 5 along section line II-II.
Figure 7:
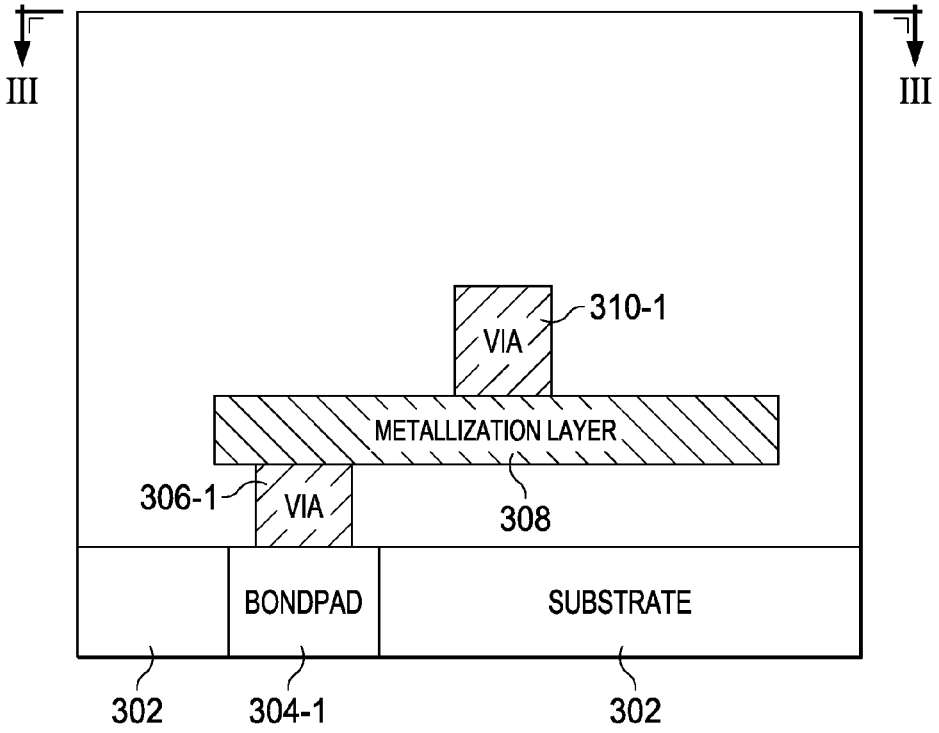
FIG. 7 is a cross-sectional view of FIG. 5 along section line III-III.

In FIG. 2, an example of the antenna package 104 can be seen in greater detail. As shown, the antenna packages include a phased array 204 that is substantially surrounded by a high impedance surface (HIS). An example of such an HIS can be seen in U.S. patent application Ser. No. 13/116,885, which is entitled "High Impedance Surface," was filed on May 26, 2011, and is hereby incorporated by reference for all purposes. Also, as shown, the phased array 204 includes antennas 206-1 to 206-4, but any number of antennas is possible. This phased array 204 can then be used to steer the beam of radiation.

Turning to FIGS. 2-9, an example of the structure of each of the antennas 206-1 to 206-4 (hereinafter labeled 206) can be seen. Antenna 206 is generally formed over a substrate 302 and can be (for example) configured to operate at 160 GHz. For this example operating frequency, the area occupied by the antenna (as shown in FIGS. 2-9) can be 1120 μm×1120 μm. Extending through substrate 302 are bondpads 304-1 to 304-4 (which can, for example, be formed of copper). Bondpads 304-1 and 304-4 generally operate as ground terminals, while bondpads 304-2 and 304-3 generally operate as differential feed terminals (i.e., positive and negative) that communicated with RF circuitry (i.e., transceiver) on IC 106. These bondpads 304-1 to 304-4 are generally aligned with one another along a line that bisects the areas occupied by antenna 206. Additionally, vias 306-1 to 306-4 (which can, for example, be formed of tungsten) are formed over bondpads 304-1 to 304-4, respectively.

A metallization layer 308 (which can, for example, be formed of copper or aluminum) is then formed so as to be disposed over the substrate 302 with an interlayer dielectric (which is transparent to radiation in the frequency of interest, such as terahertz radiation) formed therebetween. As shown, this metallization layer 308 generally includes regions 402, 404, and 406. Region 402 substantially surrounds the window region 408 and is in electrical contact with bondpads 304-1 and 304-4 through vias 306-1 and 306-4, respectively, so as to form a ground plane. Regions 404 and 406 are generally circular regions (which can have a diameter of about 180 μm and be displaced from the edge of the window region 408 by about 40 μm) that are in electrical contact with bondpads 304-2 and 304-3, respectively, through vias 306-2 and 306-3. Vias 310-1 and 310-2 (which can also, for example, be formed of tungsten) can be formed over regions 404 and 406, respectively, and vias 310-3 to 310-18 (which can also, for example, be formed of tungsten and be separated from one another by about 220 μm) are located on region 402 along its periphery so as to substantially form a "via wall."

Figure 8:
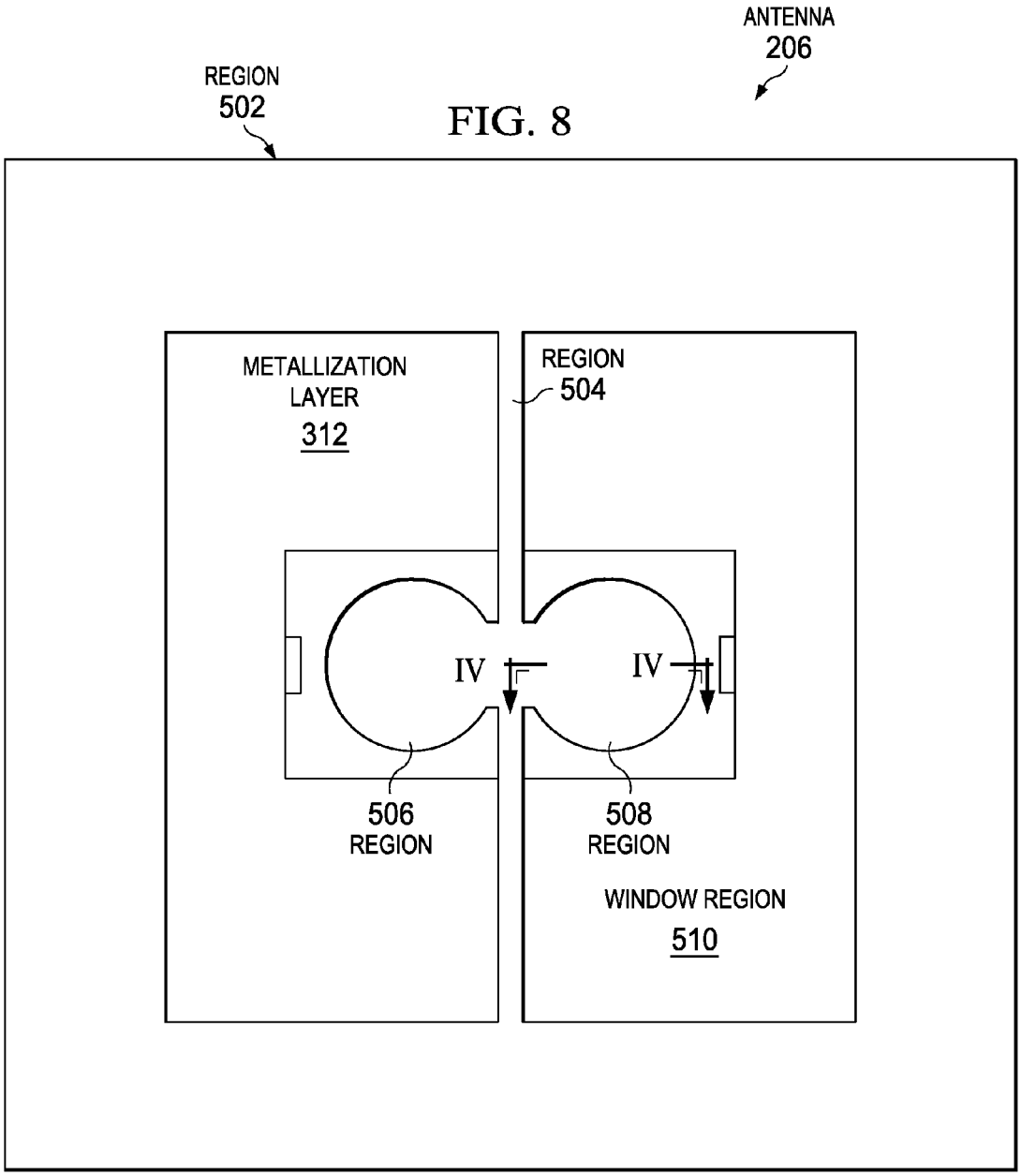
FIG. 8 is a plan view of a metallization layer for the antenna of FIG. 2.

As shown in FIGS. 8 and 9, a metallization layer 312 is disposed over metallization layer 308 with an interlayer dielectric formed therebetween. Region 502 of metallization layer 312 (which can, for example, be formed of copper or aluminum) substantially surrounds window region 510 and extends to the periphery of the area that the antenna 206 occupies (which can have a width of about 181 μm). Region 504 extends across window region 510 (and is in electrical contact with region 502) so as to bisect window region 510 and to intersect regions 506 and 508 (i.e., at about 330 μm from region 502). Regions 508 and 506 (which are located within window region 506) are generally coextensive with regions 404 and 406 (i.e., having a diameter of about 180 μm) an begin in electrical contact with region 504 and regions 404 and 406. Thus, as show, the widow region 506 is partially aligned with window region 408.

By using this structure to, for example, generate radiation at 160 GHz, the radiation pattern shown in FIG. 10 can be produced. As shown in this example, this is a wide beam with a directivity of 5.36 dBi, a gain of 4.18 dBi, and an efficiency of 72%. Additionally, because of the arrangement of the system 100, radiation propagates away from PCB 102 so that parasitic radiation and interference from PCB trances and be reduced, and the loop antenna (i.e., antenna 206), which has a quarter wavelength line to the ground to the package substrate 302, has reduced sensitivity to electrostatic discharge or ESD. Moreover, metal layers in both the antenna package 104 and IC 106 can be used to form reflectors and directors to increase antenna gain.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a substrate having a first feed terminal, a second feed terminal, and a ground terminal;

a first metallization layer disposed over the substrate, wherein the first metallization layer includes:

a first window region;

a first conductive region disposed over and in electrical contact with the first feed terminal, wherein first conductive region is substantially circular, and wherein the first conductive region is located within the first window region;

a second conductive region disposed over and in electrical contact with the second feed terminal, wherein the second conductive region is substantially circular, and wherein the first conductive region is located within the first window region; and a third conductive region disposed over and in electrical contact with the ground terminal, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region;

wherein the ground terminal further comprises a first ground terminal, and wherein the substrate has a second ground terminal, and wherein the first feed terminal, the second feed terminal, the first ground terminal, and the second ground terminal are substantially aligned;

wherein the first window region is substantially rectangular;

wherein the apparatus further comprises:

a first via that extends between the first ground terminal and the third conductive region;

a second via that extends between the second ground terminal and the third conductive region;

a third via that extends between the first feed terminal and the first conductive region; and a fourth via that extends between the second feed terminal and the second conductive region;

wherein the second metallization layer further comprises:

a fourth conductive region that substantially surrounds the second widow conductive region and that is in electrical contact with the third conductive region;

a fifth conductive region that bisects the second window region and that is electrical contact with the fourth conductive region;

a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

2. The apparatus of claim 1, wherein the apparatus further comprises:

a set of fifth vias that extends between the third and fourth conductive regions;

a sixth via that extends between the first and sixth conductive regions; and a seventh via that extends between the second and seventh conductive regions.

3. The apparatus of claim 2, wherein the first feed terminal, the second feed terminal, the first ground terminal, and the second ground terminal are bondpads.

4. An apparatus comprising:

an integrated circuit (IC) having:

radio frequency (RF) circuitry;

a first bondpad that is coupled to the RF circuitry;

a second bondpad that is coupled to the RF circuitry; and a third bondpad that is coupled to the RF circuitry and that is coupled to ground;

an antenna package having:

a substrate;

a fourth bondpad that is located in the substrate and that is in electrical contact with the first bondpad;

a fifth bondpad that is located in the substrate and that is in electrical contact with the second bondpad;

a sixth bondpad that is located in the substrate and that is in electrical contact with the third bondpad;

a first metallization layer disposed over the substrate, wherein the first metallization layer includes:

a first window region;

a first conductive region disposed over and in electrical contact with the fourth bondpad, wherein first conductive region is substantially circular, and wherein the first conductive region is located within the first window region;

a second conductive region disposed over and in electrical contact with the fifth bondpad, wherein the second conductive region is substantially circular, and wherein the first conductive region is located within the first window region; and a third conductive region disposed over and in electrical contact with the sixth bondpad, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region.

5. The apparatus of claim 4, wherein antenna package further comprises a seventh bondpad, and wherein the fourth, fifth, sixth, and seventh bond pads are substantially aligned, and wherein the IC further comprises an eighth bondpad that is coupled to the RF circuitry and that is coupled to ground, and wherein the seventh bondpad is in electrical contact with the eighth bondpad.

6. The apparatus of claim 5, wherein the first window region is substantially rectangular.

7. The apparatus of claim 6, wherein the apparatus further comprises:

a first via that extends between the sixth bondpad and the third conductive region;

a second via that extends between the seventh bondpad and the third conductive region;

a third via that extends between the fourth bondpad and the first conductive region; and a fourth via that extends between the fifth bondpad and the second conductive region.

8. The apparatus of claim 7, wherein the second metallization layer further comprises:

a fourth conductive region that substantially surrounds the second widow conductive region and that is in electrical contact with the third conductive region;

a fifth conductive region that bisects the second window conductive region and that is electrical contact with the fourth conductive region;

a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

9. The apparatus of claim 8, wherein the apparatus further comprises:

a set of fifth vias that extends between the third and fourth conductive regions;

a sixth via that extends between the first and sixth conductive regions; and a seventh via that extends between the second and seventh conductive regions.

10. An apparatus comprising:

an integrated circuit (IC) having:

a plurality of RF transceivers;

a plurality of sets of bondpads, wherein each set of bondpads is associated with at least one of the RF transceivers, and wherein each set of bondpads includes:

a first bondpad that is coupled to its associated RF transceiver;

a second bondpad that is coupled to its associated RF transceiver;

a third bondpad that is coupled to its associated RF transceiver and that is coupled to ground; and a fourth bondpad that is coupled to its associated RF transceiver and that is coupled to ground;

an antenna package having:

a substrate;

an array of antenna, wherein each antenna is associated with at least of the RF transceivers, and wherein each antenna includes:

a fifth bondpad that is located in the substrate and that is in electrical contact with its associated first bondpad;

a sixth bondpad that is located in the substrate and that is in electrical contact with its associated second bondpad;

a seventh bondpad that is located in the substrate and that is in electrical contact with its associated third bondpad;

an eighth bondpad that is located in the substrate and that is in electrical contact with its associated third bondpad, wherein the fifth, sixth, seventh, and eight bondpads are substantially aligned;

a first metallization layer disposed over the substrate, wherein the first metallization layer includes:

a first window region;

a first conductive region disposed over and in electrical contact with the fifth bondpad, wherein first conductive region is substantially circular, and wherein the first conductive region is located within the first window region;

a second conductive region disposed over and in electrical contact with the sixth bondpad, wherein the second conductive region is substantially circular, and wherein the first conductive region is located within the first window region; and a third conductive region disposed over and in electrical contact with the seventh and eighth bondpads, wherein the third conductive region substantially surrounds the first window region; and a second metallization layer disposed over and in electrical contact with the first, second, and third conductive regions of the first metallization layer, wherein the second metallization layer includes a second window region that is at least partially aligned with the first window region; and a high impedance surface (HIS) disposed on the substrate and substantially surrounding the array of antennas.

11. The apparatus of claim 10, wherein the first window region is substantially rectangular.

12. The apparatus of claim 11, wherein the apparatus further comprises:

a first via that extends between the seventh bondpad and the third conductive region;

a second via that extends between the eighth bondpad and the third conductive region;

a third via that extends between the fifth bondpad and the first conductive region; and a fourth via that extends between the sixth bondpad and the second conductive region.

13. The apparatus of claim 12, wherein the second metallization layer further comprises:

a fourth conductive region that substantially surrounds the second widow conductive region and that is in electrical contact with the third conductive region;

a fifth conductive region that bisects the second window conductive region and that is electrical contact with the fourth conductive region;

a sixth conductive region that is disposed over the first conductive region, is generally coextensive with the first conductive region, and is in electrical contact with the first and fifth conductive regions; and a seventh conductive region that is disposed over the second conductive region, is generally coextensive with the second conductive region, and is in electrical contact with the second and fifth conductive regions.

14. The apparatus of claim 13, wherein the apparatus further comprises:

a set of fifth vias that extends between the third and fourth conductive regions;

a sixth via that extends between the first and sixth conductive regions; and a seventh via that extends between the second and seventh conductive regions.

* * * * *